US006129791A

United States Patent [19]

Nakajima et al.

[11] Patent Number: 6,129,791

[45] Date of Patent: Oct. 10, 2000

[54] OXIDES DISPERSION STEEL AND MAKING PROCESS THEREOF

[75] Inventors: Hiroshi Nakajima; Shiro Torizuka; Kaneaki Tsuzaki; Kotobu Nagai, all of Ibaraki, Japan

[73] Assignees: Japan as represented by Director General of National Research Institute for Metals, Ibaraki; Mitsubishi Heavy Industries, Ltd., Tokyo, both of Japan

[21] Appl. No.: 09/389,063

[22] Filed: Sep. 2, 1999

[30] Foreign Application Priority Data

Sep. 2, 1998 [JP] Japan ..... 10-248483

[51] Int. Cl.[7] ..... C22C 38/00

[52] U.S. Cl. ..... 148/320; 148/328; 148/540; 420/8

[58] Field of Search ..... 148/320, 328, 148/540; 420/8

[56] References Cited

U.S. PATENT DOCUMENTS

| | | | |
|---|---|---|---|
| 4,881,990 | 11/1989 | Pielet et al. | 148/320 |
| 5,690,753 | 11/1997 | Kawauchi et al. | 148/320 |
| 5,705,124 | 1/1998 | Ochi et al. | 420/105 |
| 5,985,053 | 11/1999 | Hara et al. | 148/335 |

*Primary Examiner*—Ngoclan Mai
*Attorney, Agent, or Firm*—Wenderoth, Lind & Ponack, L.L.P.

[57] ABSTRACT

In carbon steel, oxides with grain diameter of 1 $\mu$m or less and with grain spacing of 6 $\mu$m or less are dispersed to suppress growth of $\gamma$ grains by heating at $\gamma$ region temperature.

10 Claims, 5 Drawing Sheets

OXIDES DISPERSION STEEL AND MAKING PROCESS THEREOF

FIELD OF THE INVENTION

The present invention relates to oxides dispersion steel and making process thereof. More particularly, the present invention relates to oxides dispersion steel capable of preventing γ grains form growing and making process for the oxide dispersion steel in which fine oxide grains are uniformly dispersed.

DESCRIPTION OF THE PRIOR ART

Fining ferrite(α) grains are demanded to strengthen carbon steel. One of the necessary conditions to meet the demand is to prevent austenite(γ) grains before transformation from growing and to diminish deformation resistance at working. Fining γ grains by rolling has been known as a means for suppressing growth of γ grains at γ region temperature. However, it needs some times of rolling to obtain γ grains with prescribed diameters and therefore efficiency is not always good.

Dispersion of oxides in a structure of carbon steel has begun to be considered.

In general, oxides are dispersed by directly adding oxide powders with prescribed diameter to molten steel or by adding a mixture of metal powders and oxide powders, which is formed into a wire shape, to molten steel. Actually, in either manner, fine oxides are not only obtained and besides oxides are not dispersed uniformly. It is because oxide powders are apt to combine and aggregate and large bulky secondary grains are formed.

The present invention has an object to provide oxides dispersion steel capable of preventing γ grains form growing and making process for the oxide dispersion steel in which fine oxide grains are uniformly dispersed.

This and other objects, features and advantages of the invention will become more apparent upon a reading of the following detailed specification and drawing, in which:

SUMMARY OF THE INVENTION

Figure 1:
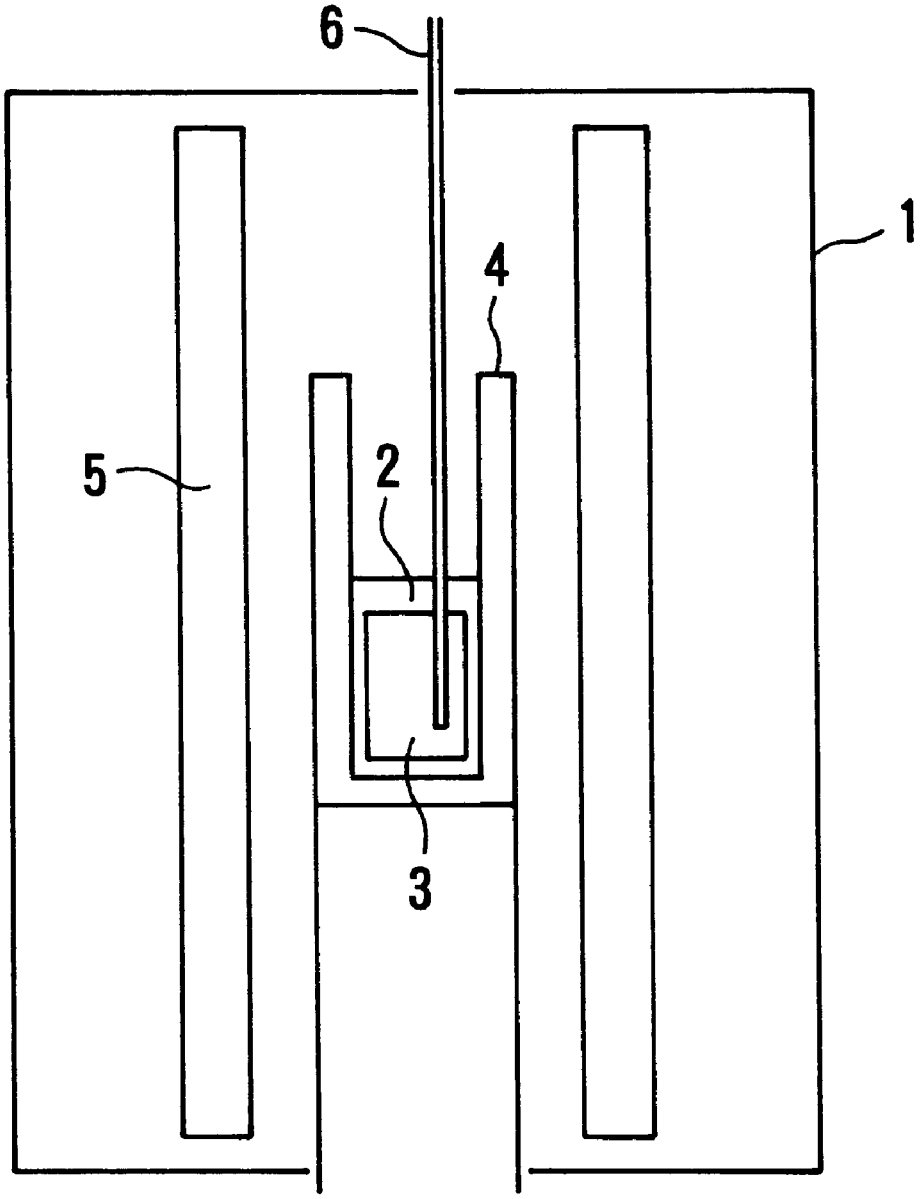
FIG. 1 is a schematic view showing formation of molten steel in Example 1.

The present invention provides oxides dispersion steel in which fine oxide grains with diameter of 1 μm or less are uniformly dispersed in carbon steel in a state that grain spacing is 6 μm or less.

As one of the embodiments of the oxides dispersion steel, oxides dispersion steel has chemical compositions containing C in amount of 0.8 mass % or less, Si in amount of 0.5 mass % or less, Mn in amount of 3.0 mass % or less, S in amount of 0.02 mass % or less, and one or more elements among Ti, Mg or Al in amount of 0.3 mass % or less.

The present invention also provides, as a making process for the oxides dispersion steel above-mentioned, a making process of oxides dispersion steel, which comprises the steps of cooling molten steel while holding said molten steel so as not to contact surface of the molten steel with a material to be a solidification site and precipitating oxides from the molten steel in an undercooling condition. As an embodiment of the making process, an undercooling condition is achieved by the following manners: melting and cooling steel in a non-contact state, wrapping molten steel with slag of plural oxides, or flowing molten steel into slag of plural oxides.

DETAILED DESCRIPTION OF THE INVENTION

The inventors of the present invention, as a result of eagerly studying the above-mentioned problems, found that solidification rate is improved by undercooling solidification as compared with rapid solidification and that the distance between each secondary dendrite arm where secondary deoxidation products, i.e., oxides, are precipitated is shortened. The inventors also confirmed that the distance between precipitated oxides and diameter of the oxides is possible to be controlled. The distance between each oxide that is precipitated by undercooling solidification is followed by an experimental formula such as;

$$D=(1.15\times10^{6}/(800\ \Delta T+8000))^{0.5}$$

where D: grain spacing(μm), ΔT: degree of undercooling (K).

An undercooling condition is a condition that a material is in a liquid state but temperature of the material is under liquidus temperature. In the present invention, a undercooling condition is realized by cooling molten steel while holding the molten steel so as not to contact surface of the molten steel with a material such as a refractory material or a mold that is to be a solidification nucleation. More specifically, the undercooling condition is realized by melting and cooling steel in a non-contact state, wrapping molten steel with slag of plural oxides, or flowing molten steel into slag of plural oxides. Temperature of molten steel in the undercooling condition thus formed is under its liquidus temperature. In the case of melting and cooling in a non-contact state, for example, molten steel can be floated against gravity by magnetic pressure which is generated by a high-frequency magnetic field more than 1 kHz. The surface of the molten steel in such a non-contact condition can be intensely cooled through convection cooling together with radiation cooling.

Oxides with fine grain size, of which grain spacing is followed the above-mentioned formula, are precipitated from undercooled molten steel. As a result, fine oxides are uniformly dispersed in a structure.

With regard to uniform dispersion of fine oxides, in the present invention, grain diameter is 1 μm or less and grain spacing is 6 μm or less.

Grain diameter is regulated according to destruction. As far as grain diameter is 1 μm or less, oxides are seldom a starting point of destruction. Grain spacing substantially means dispersion density and is regulated by grain diameter permitted to a γ grain which grows according to heating. Grain spacing of 6 μm or less corresponds to volume fractions which realize that grain diameter of a γ grain growing at γ region temperature is 60 μm or less.

Chemical compositions of oxide dispersion steel are, in general, those which contains C in amount of 0.8 mass % or less, Si in amount of 0.5 mass % or less, Mn in amount of 3.0 mass % or less, S in amount of 0.02 mass % or less, and one or more elements among Ti, Mg or Al in amount of 0.3 mass % or less. In these constituent elements, Ti, Mg and Al are elements which form oxides and are usually selected as an element for forming oxides which are dispersed in carbon steel. With regard to these three elements, about 30% of the blending amount change into oxides. The blending amount of 0.3 mass % or less corresponds to the amount which realizes that oxides have grain diameter of 1 μm or less and grain spacing of 6 μm or less.

With regard to the blending amount of constituent elements, only upper limits are described, but this does not intend that the blending amount includes 0%. It is because, in fact, grain diameter, grain spacing and mass % is not be 0% even if they come to be near 0% without limit.

In the present invention as above-mentioned, fine oxides can be uniformly dispersed in a structure of carbon steel, this suppressing growth of γ grains according to heating and reducing diameter of γ grains. Conditions for fining ferrite grains are relieved and, for example, the amount and time of working at rolling for obtaining finer γ grains are diminished.

EXAMPLES

Example 1

TABLE 1

| | Chemical composition | | | | | |
|---|---|---|---|---|---|---|
| | C | Si | Mn | P | S | Ti |
| mass % | 0.15 | 0.19 | 1.51 | 0.019 | 0.02 | 0.08 |

Figure 2:
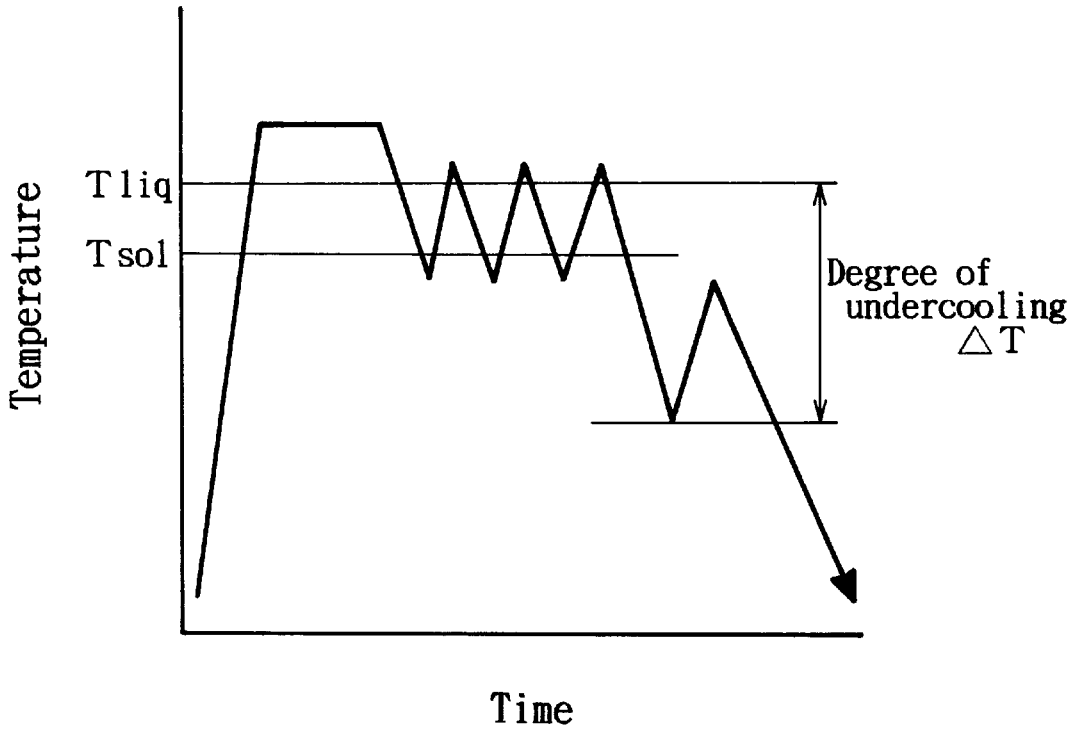
FIG. 2 is a conceptual time-temperature diagram, which shows undercooling solidification of molten steel.

Steel with the chemical composition shown in Table 1 was buried in oxides mixture powders or particles such as $SiO_2$, $Al_2O_3$ and $Na_2O$ and was molten by a Tammann furnace (1) as illustrated in FIG. 1 in a non-oxidation atmosphere. Molten steel (3) was heated at temperature by 50° C. higher than liquidus temperature and was held at the temperature until primary deoxidation products were absorbed to the glassy oxides mixture, i.e., slag (2). The molten steel (3) was subsequently solidified by undercooling while the molten steel (3) was wrapped with the slag (2). The difference between temperature of the molten steel (3) and liquidus temperature, that is, degree of undercooling (ΔT) as shown in FIG. 2 was 40K.

The other symbols described in FIG. 1 show as follows:

4 is a crucible; 5 is a graphite heater; and 6 is a thermocouple.

Figure 3:
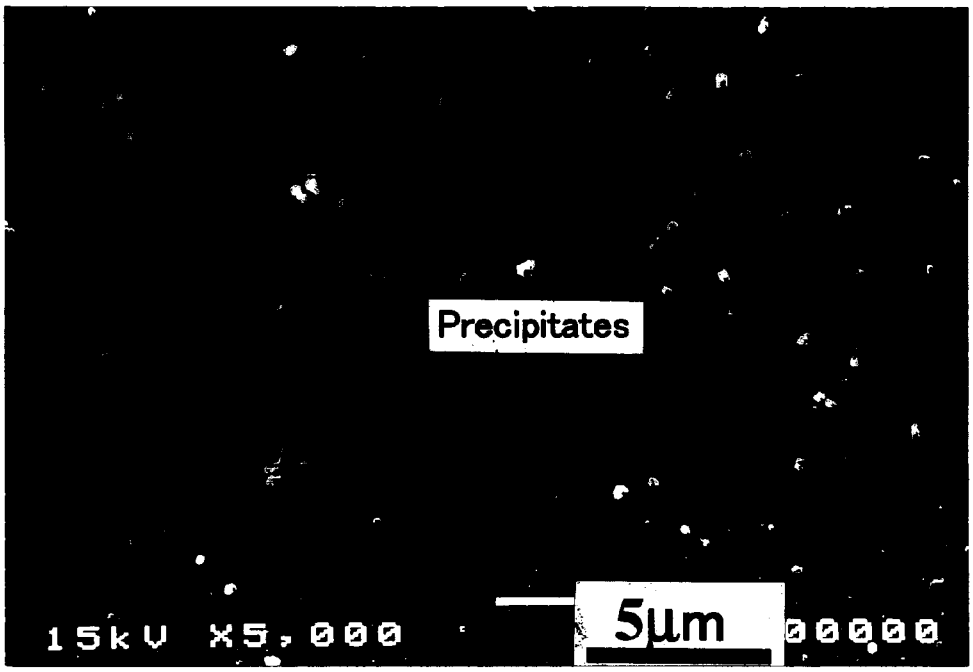
FIG. 3 is a scanning electron micrograph photo in place of drawing, which shows dispersed precipitates of a sample solidified by undercooling.

In the casted piece, as shown in FIG. 3, average grain diameter of precipitated oxides is 1 μm and average grain spacing is 5.4 μm. The grain diameter and spacing in the center of the casted piece with thickness of 10 cm are as same as those. Oxides are uniformly and finely dispersed.

Growth of γ grains by heating int he casted piece was examined. γ grain diameter when the casted piece was rapidly cooled after holding the piece at 1200° C. for time up to 10000 seconds was measured. The results are shown in a graph of FIG. 4. As is clear from comparison with comparison 1, it is confirmed that growth of γ grains is suppressed. The casted piece was subjected to heat treatment which is almost the same condition of heat affected zone. Namely, the casted piece was rapidly cooled after holding at 1400° C. for an hour. The diameter of γ grains is 75 μm and growth of γ grains is suppressed.

Figure 5:
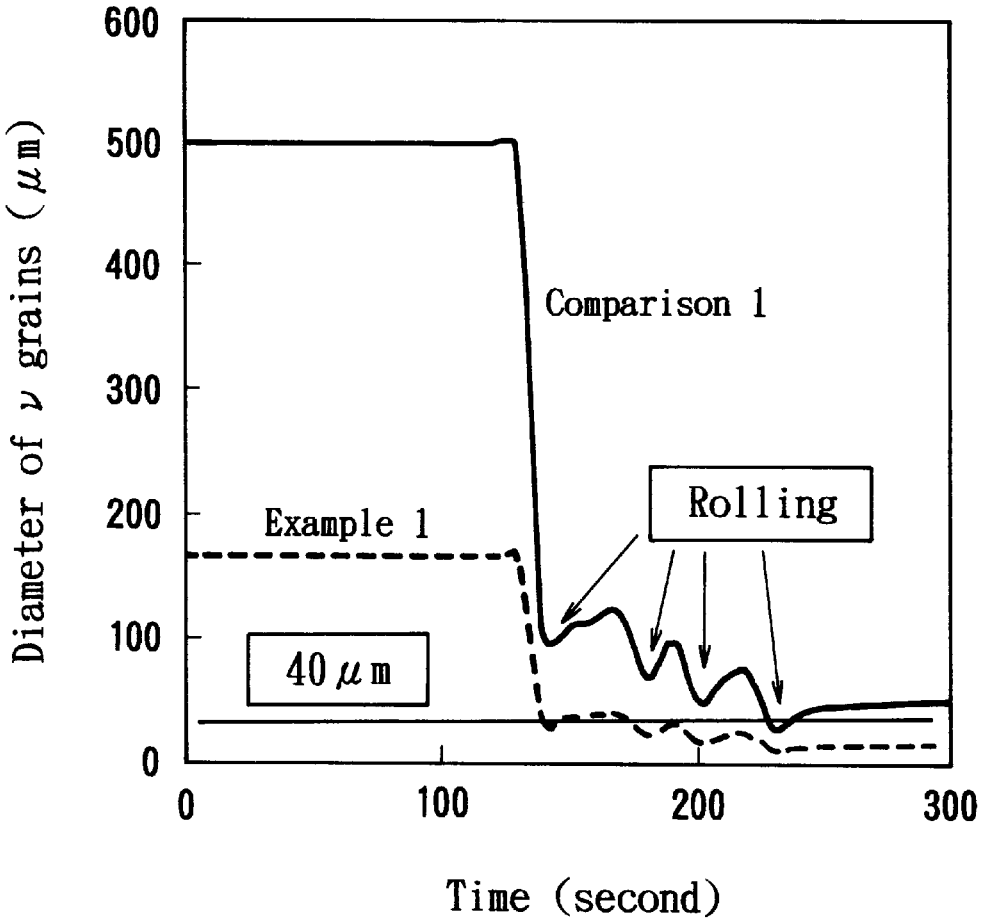
FIG. 5 is a graph showing diameter of γ grains in a relationship of heating and working time when samples were heated and rolled on the way of heating.

Growth of γ grains when heating the casted piece during rolling effective for fining γ grains was also examined. The casted piece was held at 1200° C. till till the first working and was subsequently rolled four times. After the final rolling, the rolled piece was held at 750° C. The results are shown in FIG. 5. As is clear from FIG. 5, γ grains are reduced and fined by rolling. Grain diameter of 40 μm or less was realized only by one time of rolling. As compared with Comparison 1, it is confirmed that γ grains are efficiently fined.

Comparison 1

The steel as shown in Table 1 was cooled without wrapping of slag and was solidified in the condition that undercooling did not occur. Grain diameter of the precipitated oxides which were positioned at 10 mm from the surface of the casted piece was larger than 1 μm. Average grain spacing was 17 μm.

Figure 4:
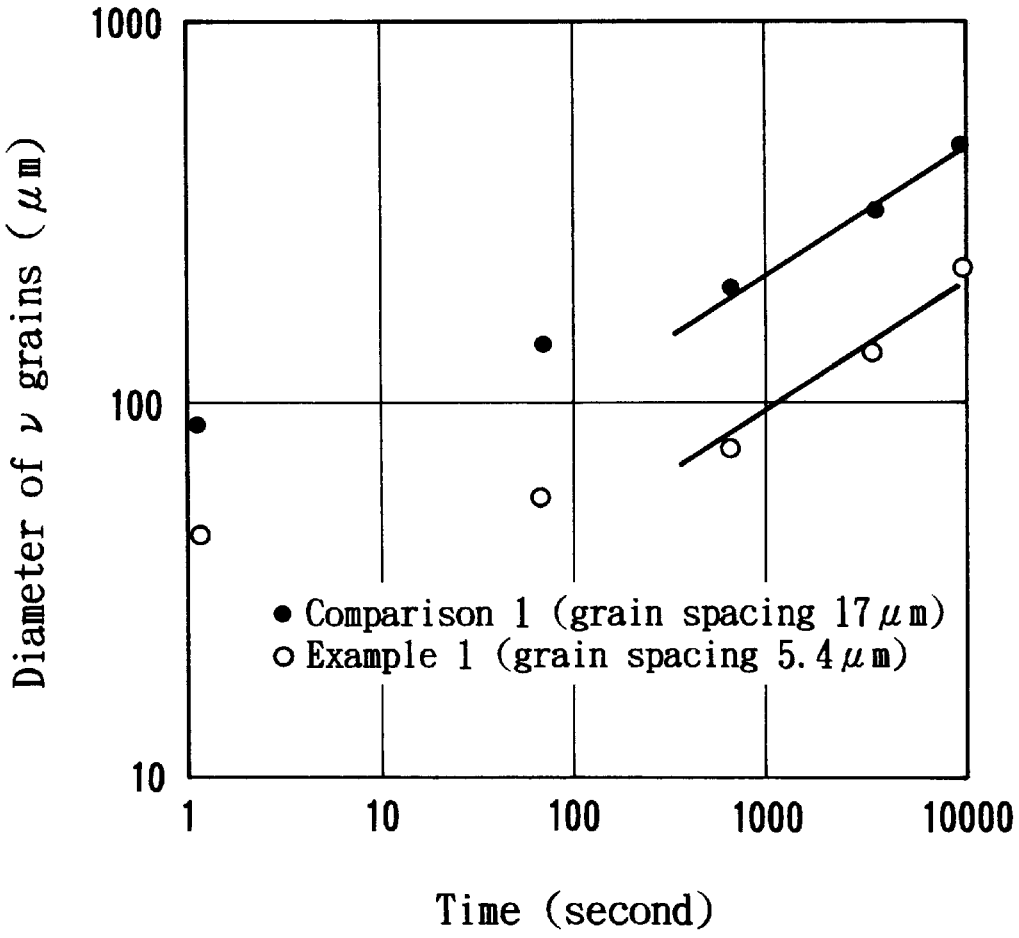
FIG. 4 is a graph showing a relationship between heating time and diameter of γ grains when samples were heated at 1200° C.

Growth of γ grains by heating was examined. Grain diameter when the casted piece was held at 1200° C. for time up to 10000 seconds and then rapidly cooled was measured. The results are also shown in FIG. 4. Growth of γ grains is larger than that of the piece to which solidification by undercooling was subjected. The amount of working for producing α grains from grain boundaries between γ grains deformed by heating is three times as much as that in the case of the material obtained by undercooling solidification. This fact means that more energy is needed for working and that large scale of working machines are necessary.

The casted piece was subjected to heat treatment which is almost the same condition of heat affected zone. Namely, the casted piece was rapidly cooled after holding the piece at 1400° C. for 1 second. The diameter of γ grains is 215 μm which is three times as large as that of the material obtained by undercooling solidification.

As is similar in Example 1, growth of γ grains when heating the casted piece during rolling was also examined. The results are shown in FIG. 5. As is clear from FIG. 5, γ grains grow large and four-time rolling was necessary to obtain fine γ grains with diameter of 40 μm or less.

It is needless to mention that the present invention is not restricted to examples above-mentioned. Not to speak of chemical compositions of carbon steel and slag, or degree of undercooling, several modifications are possible.

What is claimed is:

1. Oxides dispersion steel in which fine oxide grains with diameter of 1 μm or less are uniformly dispersed in carbon steel in a state that grain spacing is 6 μm or less.

2. The oxides dispersion steel as claimed in claim 1, which has chemical compositions containing C in amount of 0.8 mass % or less, Si in amount of 0.5 mass % or less, Mn in amount of 3.0 mass % or less, S in amount of 0.02 mass % or less, and one or more elements among Ti, Mg or Al in amount of 0.3 mass % or less.

3. A making process of oxides dispersion steel as claimed in claim 1, which comprises the steps of cooling molten steel while holding said molten steel so as not to contact surface of the molten steel with a material to be a solidification site and precipitating oxides from the molten steel in an undercooling condition.

4. A making process of oxides dispersion steel as claimed in claim 2, which comprises the steps of cooling molten steel while holding said molten steel so as not to contact surface of the molten steel with a material to be a solidification site and precipitating oxides from the molten steel in an undercooling condition.

5. The making process as claimed in claim 3, wherein said undercooling condition is achieved by melting and cooling steel in a non-contact state.

6. The making process as claimed in claim 3, wherein said undercooling condition is achieved by wrapping molten steel with slag of plural oxides.

7. The making process as claimed in claim 3, wherein said undercooling state is achieved by flowing molten steel into slag of plural oxides.

8. The making process as claimed in claim 4, wherein said undercooling condition is achieved by melting and cooling steel in a non-contact state.

9. The making process as claimed in claim 4, wherein said undercooling condition is achieved by wrapping molten steel with slag of plural oxides.

10. The making process as claimed in claim 4, wherein said undercooling condition is achieved by flowing molten steel into slag of plural oxides.

* * * * *